United States Patent [19]

Furrow

[11] Patent Number: 4,519,585

[45] Date of Patent: May 28, 1985

[54] DRAWWORKS BRAKE CONTROL

[75] Inventor: Robert E. Furrow, Enid, Okla.

[73] Assignee: Cooper Industries, Houston, Tex.

[21] Appl. No.: 433,895

[22] Filed: Oct. 12, 1982

[51] Int. Cl.[3] ..... B66D 1/50; B66D 5/26

[52] U.S. Cl. ..... 254/273; 254/379; 303/13

[58] Field of Search ..... 254/267, 273, 275, 379; 192/0.034; 188/77 R, 170; 303/13; 91/6, 425, 465

[56] References Cited

U.S. PATENT DOCUMENTS

| | | | |
|---|---|---|---|
| Re. 24,818 | 4/1960 | Gresham et al. . | |
| 1,779,656 | 10/1930 | Brauer . | |
| 1,919,611 | 7/1933 | Besigk . | |
| 2,117,078 | 5/1938 | Brauer . | |
| 2,274,339 | 2/1942 | Loomis | 254/273 X |
| 2,528,883 | 11/1950 | Hayward . | |
| 2,663,386 | 12/1953 | Fenley . | |
| 2,703,008 | 3/1955 | Seljos et al. . | |
| 2,809,518 | 10/1957 | Grandstaff . | |
| 3,373,823 | 3/1968 | Fullerton et al. . | |
| 3,605,919 | 9/1971 | Bromell et al. . | |
| 3,759,489 | 9/1973 | Jones | 254/379 |
| 3,836,122 | 9/1974 | Pierce, Jr. | 254/273 |
| 3,990,583 | 11/1976 | Nishida et al. | 91/465 X |
| 4,046,355 | 9/1977 | Martin . | |

OTHER PUBLICATIONS

Article entitled, "Drillers Take a Look at Automation", *Oil and Gas Journal*, Aug., 1957, pp. 9-26.

*Primary Examiner*—Stuart S. Levy
*Assistant Examiner*—Katherine Jaekel
*Attorney, Agent, or Firm*—Alan T. McCollom; Eddie E. Scott

[57] ABSTRACT

Apparatus for controlling a brake on a drawworks having cable wound thereon. A tension gauge detects the tension in the cable which is displayed on a switch gauge. A pulse generator provides periodic pulses to one side of a relay having a set of normally open contacts. When the tension is at or above a preselected level, the other side of the relay is grounded. The relay contacts pulse a pneumatic relay which is connected to a ram that operates the drawworks brakes. When tension is at or below a preselected level, a second pneumatic relay is actuated for maintaining the ram in a brake activating condition. A switch is connected to a third pneumatic relay, which in turn is connected to the ram to permit manual brake activation and deactivation.

6 Claims, 2 Drawing Figures

DRAWWORKS BRAKE CONTROL

BACKGROUND AND SUMMARY OF THE INVENTION

The instant invention pertains to apparatus for controlling a brake on a drawworks and more particularly to such apparatus which incorporates a fluidic ram for moving a brake handle on the drawworks.

In the drilling of oil and gas wells, a block-and-tackle arrangement is used for suspending a drill string therefrom. The block-and-tackle arrangement is used to raise and lower the drill string into and out of the well bore. A large winch, known as the drawworks, is used to pay out and reel in the cable in the block-and-tackle arrangement for raising and lowering the drill string.

During drilling, the drawworks is stopped at a selected position so that a drill bit suspended from the lower end of the drill string is at the bottom of the hole. A rotary table on the drilling rig imparts rotary motion to the drill string thereby causing additional downward drilling in the bore. It can be seen that as drilling progresses, the weight of the drill string bearing down on the drill bit decreases. The drawworks is equipped with a brake which locks it into position. The brake includes a handle which extends outwardly from the drawworks. When the handle is raised, the brake is released thereby permitting additional cable to be paid out and thus increasing the weight of the drill string on the bit. As drilling further proceeds, the weight of the drill string on the bit again lessens thus requiring deactivation of the brake to again increase the weight of the drill string on the bit.

In the past, several types of apparatus have been proposed for monitoring the drilling operation and for deactivating the brake when appropriate. Such past apparatus generally include a tension gauge for detecting tension in the drawworks cable, such tension being inversely proportional to the weight of the drill string on the bit. A fluidic ram is attached to the brake handle for deactivating the brake responsive to ram movement. Control circuitry monitors the detected cable tension and switches a source of compressed air for moving the ram when the tension is above a preselected level.

Such past apparatus suffer from several deficiencies. Some such apparatus monitor the tension and continuously adjust the brake in response to the varying tension. This leads to a condition wherein the brake may assume a position partway between being activated and deactivated. This may permit hard-to-control slippage and causes excessive brake wear. Although one past apparatus provides for switching of the brake between being activated and deactivated, it includes a complex control circuit and poses a safety hazard. Most past apparatus are limited to drilling under 100 feet per hour.

It is a general object of the instant invention to overcome the above-enumerated deficiencies inherent in past brake control apparatus.

It is a more specific object of the instant invention to provide such apparatus having increased safety.

It is another specific object of the invention to provide such apparatus which is relatively simple in construction and easy to maintain.

It is yet another specific object of the invention to provide such apparatus which includes a control for operator-controlled brake deactivation without removing the fluidic ram.

It is still another specific object of the invention to provide such apparatus which both maintains the brake in an activated condition and disengages the drawworks clutch when the tension in the cable falls below a preselected level.

It is a further specific object of the invention to provide such apparatus which permits drilling at rates in excess of 250 feet per hour.

The instant invention includes a gauge for sensing the tension level in a drawworks cable. A ram is mounted on the drawworks brake handle for deactivating the brake responsive to ram movement. A first pneumatic relay is connected to the ram for deactivating the brake responsive to relay energization. A pulse generator is connected to the first pneumatic relay for pulsing the same when the tension in the cable is above a preselected level. A second pneumatic relay is connected to the ram for maintaining the brake in an activated condition when the cable tension falls below a preselected level and for disengaging a clutch in the drawworks. A switch-operated third pneumatic relay is connected to the ram for switch-controlled brake deactivation.

The above-enumerated and other objects and advantages will become more fully apparent as the following detailed description of the invention is read in conjunction with the accompanying drawings, wherein:

FIG. 1 is a schematic view of a drilling rig platform having the instant embodiment of the invention installed thereon; and FIG. 2 is a schematic diagram of control circuitry included in the instant embodiment of the invention.

DETAILED DESCRIPTION OF THE PREFERRED EMBODIMENT OF THE INVENTION

Figure 1:
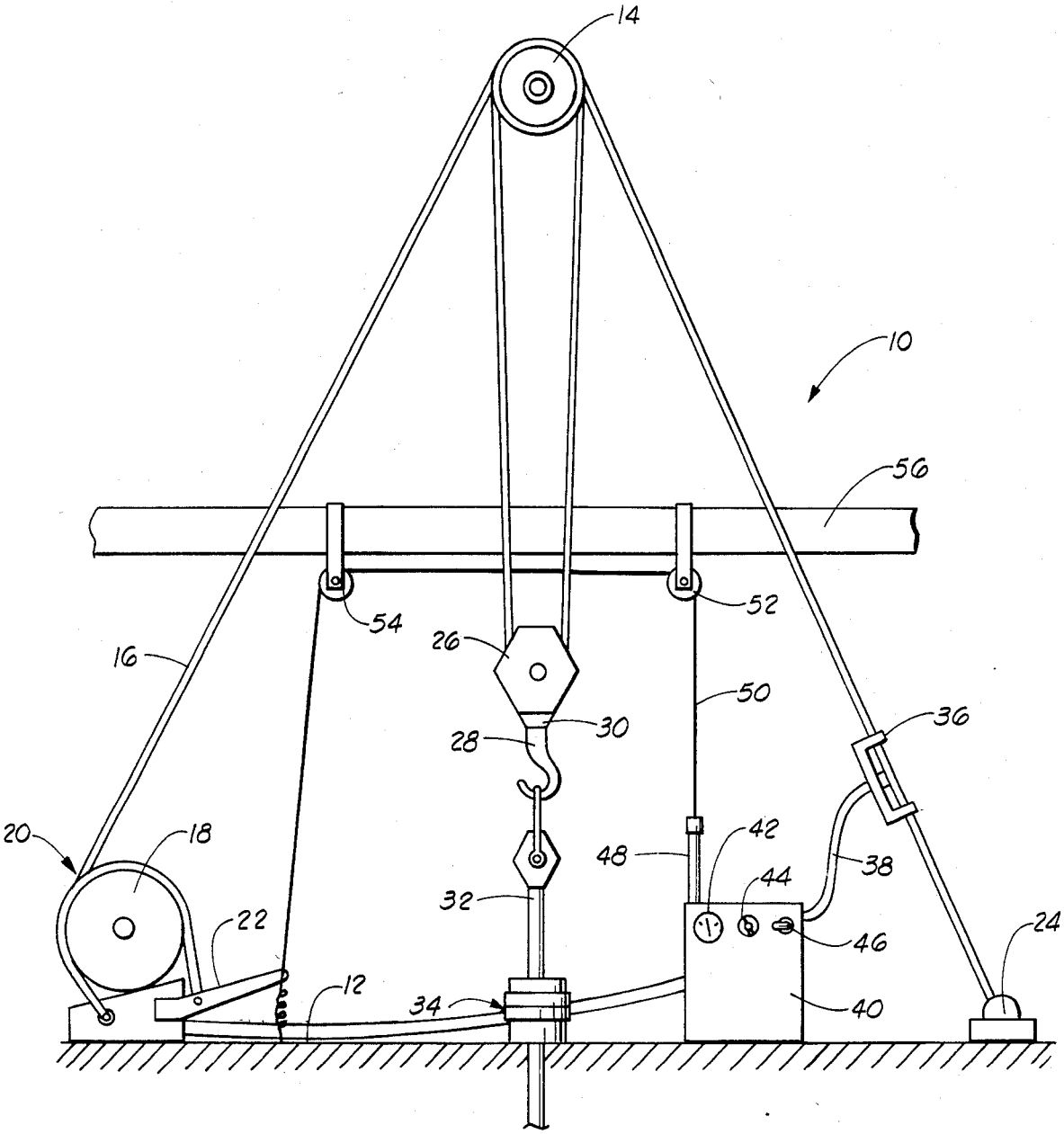

Indicated generally at 10 is a brake control constructed in accordance with the instant invention. The brake control is installed on a conventional drilling rig platform 12. The platform includes the usual mast (not shown) which extends upwardly and supports, at the top thereof, a conventional crown block 14. A cable 16 is wound onto a drum 18 of a conventional drawworks 20. Drum 18 is powered by an engine (not visible) for winding cable 16 onto the drum. A brake handle 22 is used to release a brake, which maintains drum 18 in a fixed position, by lifting upwardly on handle 22. This permits cable 16 to unwind from the drum. Handle 22 is biased downwardly to maintain the brake in an activated condition.

One end of cable 16 is attached to platform 12 via an anchor 24, the other end being wound onto the drawworks drum. Cable 16 is wound between several pulleys (not visible) in crown block 14 and pulleys (also not visible) in a traveling block 26 in the usual block-and-tackle manner. Thus, winding cable 16 onto drum 18 raises block 26, while unwinding cable from the drum lowers the block.

A hook 28 is connected to traveling block 26 via a swivel 30 which permits rotation of the hook relative to the traveling block. A drill string 32 is suspended from the hook and extends downwardly into a well bore (not shown) beneath platform 12. A conventional drill bit (also not shown) is mounted on the lower end of the drill string for drilling the well bore. The usual rotary table, indicated schematically at 34, is mounted on platform 12 for imparting rotary motion to drill string 32 for drilling the well bore.

It can be seen that as when table 34 turns, thus turning drill string 32 and causing deeper drilling in the well bore, the tension in cable 16 increases as more of the weight of the drill string is suspended from hook 28. If drilling were allowed to proceed without additional lowering of the drill string, eventually all of the weight of the drill string would be suspended from hook 28 and the well bore could be drilled no deeper.

A conventional fluid tension gauge 36 is mounted on the stationary portion of cable 16, known as the deadline, between anchor 24 and crown block 14. Gauge 36 is attached to cable 16 in the usual manner and is filled with the fluid, the pressure of which increases proportional to tension in cable 16. A hose 38 connects gauge 36 to control circuitry (shown in FIG. 2) contained within a cabinet 40. Cabinet 40 includes a tension gauge meter 42, such indicating the tension in cable 16, a rotary switch 44, and a two-position switch 46, the construction and operation of which are hereinafter more fully explained.

A rod 48 extends upwardly out of the top of cabinet 40. Rod 48 is the upper portion of a conventional pneumatic ram which is mounted on the inside of cabinet 40. The rod is shown in its extended condition. When moving into its contracted condition, the rod moves downwardly toward cabinet 40. A line 50 is attached to the top of rod 48 and extends upwardly over a pair of pulleys 52, 54 which are mounted on a beam 56 of the mast. Line 50 extends downwardly from pulley 54 and is attached to the outermost end of brake handle 22 on the drawworks.

Figure 2:
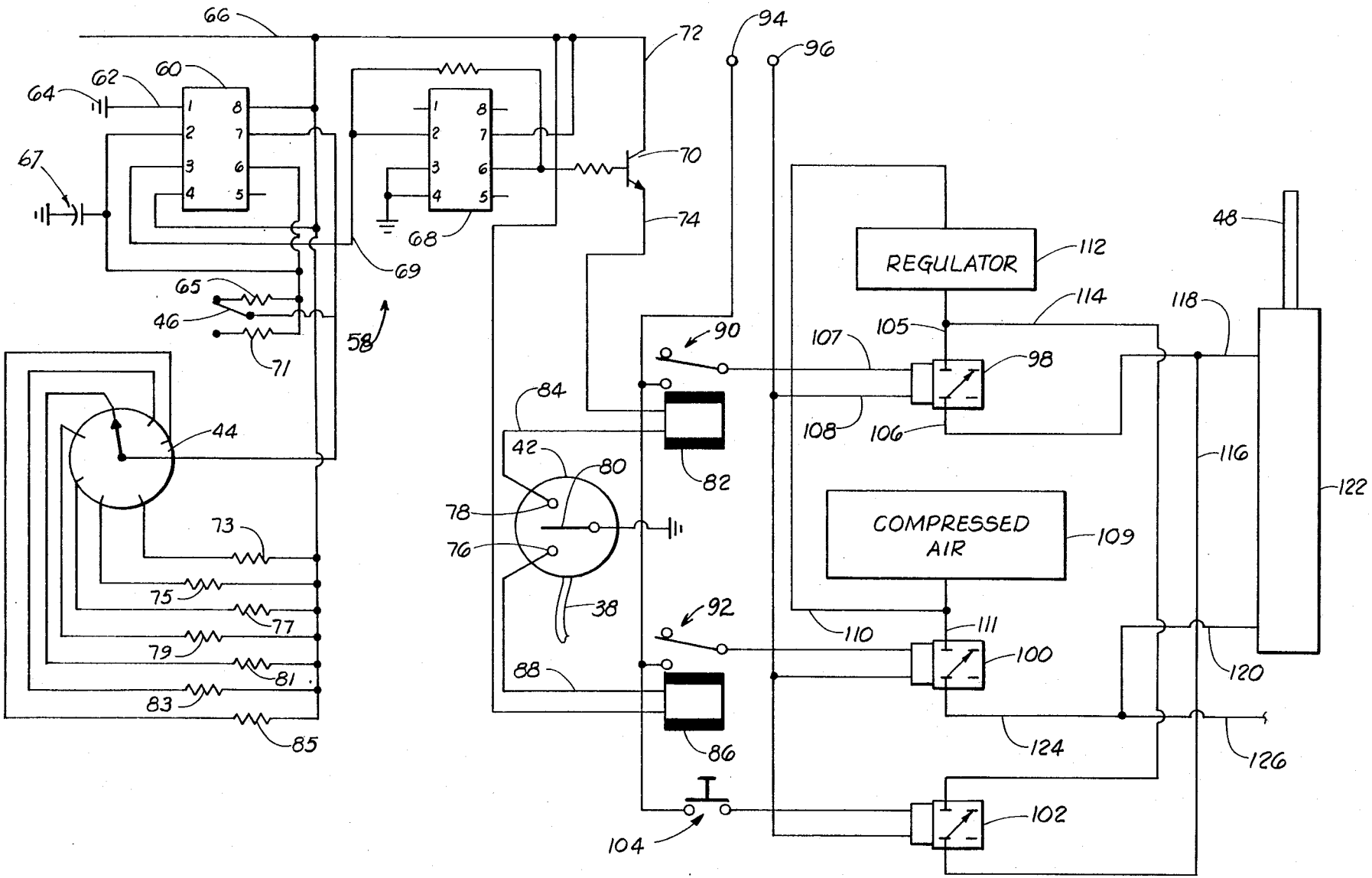

For an examination of the components contained within cabinet 40, attention is directed to FIG. 2. Components which have been named and numbered in FIG. 1 and which are shown, schematically or otherwise, in FIG. 2 have been assigned the originally designated reference numeral from FIG. 1. Indicated generally at 58 is what is referred to herein as a pulse generator. The pulse generator includes a conventional integrated-circuit timer 60, in the instant embodiment of the invention such being manufactured by National Semiconductor as an LM 555 timer. Numbers 1–8 are the timer terminal numbers. For example, terminal 1 of the timer is grounded via a conductor 62 to a ground point 64, such being designated by the usual grounding symbol. It is to be appreciated that use of the grounding symbol, like grounding symbol 64, in FIG. 2 designates a ground connection for the conductor attached to the symbol.

Timer 60 is connected to a conventional twelve-volt power supply (not shown) via terminal 8 which applies twelve volts, direct current, with respect to ground, on conductor 66. The output of the timer appears on terminal 3 and is applied to a conductor 69. The output is the usual periodic square wave varying between a relatively high voltage (near the power supply voltage) and a relatively low voltage (near ground level). Switches 44, 46 are connected to biasing resistors 65 ,71, 73, 75, 77, 79, 81, 83, 85, which can be connected to the terminals of timer 60 via switches 44, 46. For example, when switch 46 is in the position shown in FIG. 2, resistor 65 is applied between terminals 6 and 7 of the timer. When the switch is switched to its other position, resistor 71 is applied between the two terminals. In the position of rotary switch 44, resistor 81 is placed between terminals 4 and 8 (which are in common) and terminal 7. By switching the rotary switch, any of resistors 73–85 may be placed between the just-mentioned terminals.

By varying the biasing resistors as above described, the period of the signal appearing on conductor 69 is varied. Resistors 65, 71 vary the length of time the signal remains in a high condition while the resistors connected to switch 44 vary the length of time the signal remains in its low or grounded condition. Thus, in the instant embodiment of the invention, by selecting various positions of switches 44, 46, a total of fourteen different periodic signals may be placed on conductor 69. A capacitor 67 is applied between both terminals 2 and 6 of the timer and ground to provide conventional timer biasing.

An integrated-circuit operational amplifier 65 is, in the instant embodiment of the invention, manufactured by National Semiconductor and has the identifying alphanumeric designation LM 741. In the instant embodiment of the invention, the amplifier is used to invert the signal appearing on conductor 69, such inverted signal appearing on terminal 6 of amplifier 68. Thus, when the signal on conductor 69 is high, the signal on terminal 6 of the amplifier is low and vice versa. Terminal 6 is connected as shown to a conventional transistor 70 which in turn is connected to conductors 72, 74. Transistor 70 operates in the usual manner, that is, when voltage on terminal 6 goes to a high level, the transistor permits conduction between conductors 72, 74 thus applying the power supply voltage to conductor 74. When terminal 6 is in a low state, there is substantially no conduction between conductors 72, 74 thus preventing the power supply voltage from being applied to conductor 74.

Meter 42 includes a pair of selectively positionable contacts 76, 78. Also included is a movable wiper 80 which changes positions in proportion to the pressure in hose 38. As will be recalled, the hose is connected to tension gauge 36. Thus, meter 42 displays the amount of tension (and hence the weight of the drill string) which is placed on cable 16. The operator may position contacts 76, 78 so that at a preselected upper level of drill string weight, wiper 80 is placed in electrical communication with contact 78. In a similar manner, contact 76 may be adjusted so that at a selected lower weight level, the wiper and contact 76 are placed in communication, thus grounding contact 76. Meter 42 is also referred to herein as grounding means.

Contact 78 is connected to one side of a relay 82 via conductor 84. Contact 76 is connected to one side of relay 86, relay 86 being referred to herein as a second relay, via conductor 88. Each of the relays includes a set of normally open contacts 90, 92 which switch in the usual manner when the power supply voltage on conductor 66 is applied across the relay. A 110-volt AC power source (not shown) is connected across terminals 94, 96. A first pneumatic relay 98, a second pneumatic relay 100, and a third pneumatic relay 102 each have one side connected, via conductors as shown, to a conductor which in turn is connected to terminal 96. The other side of pneumatic relays 98, 100 are connected to the normally-open contacts 90, 92. The other side of pneumatic relay 102 is connected to a switch 104. Relay 98 is connected to hoses 105, 106 and, in the condition shown in FIG. 2, prevents fluid communication between hoses 105, 106. When the relay is energized, by applying 110 volts AC on conductors 107, 108, the relay changes conditions and permits fluid communication between hoses 105, 106. Each of the other pnuematic relays are substantially the same and operate in the same manner.

A source of compressed air 109 supplies such air to hoses 111, 110. A conventional regulator 112 provides pressure-regulated air from the compressed air source to hoses 105, 114. Hose 106 is in fluid communication with hoses 116, 118. A hose 120 is connected to the lower end of conventional ram 122 while hose 118 is connected to the upper end thereof. Hose 120 is in fluid communication with hoses 124, 126. Hose 126 is connected to the air clutch in the drawworks so that pressurization of hose 126 disengages the clutch and thus prevents the drawworks from reeling in cable.

In operation, it is assumed that switches 44, 46 are initially placed in arbitrarily selected positions. Initially, assuming the bit is approximately 10 feet above the bottom of the bore, the unit may be turned on. The high tension in the cable causes pulsing deactivation of the brake (in a manner to be more fully described) until the bit is on the bottom. As drilling progresses, the tension in cable 16 increases. Such tension is sensed by gauge 36 and is conveyed to meter 42 via hose 38. As the tension increases, wiper 80 moves closer to contact 78. Contact 78 is positioned by an operator at a preselected level at which it is desired to have additional drill string weight applied to the drill bit. When the preselected weight is reached, such is displayed on the meter and wiper 80 is placed in electrical communication with contact 78. When such occurs, relay 82 is grounded via conductor 84 and the periodic pulse pattern appearing on conductor 74 switches relay 82 on and off in accordance with the periodic pattern. Thus, the contacts of relay 82 are shut and opened in accordance with the pattern and relay 98 is thus energized and deenergized in accordance therewith. When relay 98 is energized, pressure passes from hose 105 to hose 106 and ultimately enters the upper end of ram 122 via hose 118 thus contracting rod 48 and, as shown in FIG. 1, deactivating the brake by pulling line 50.

When the brake is deactivated, cable 16 is let out from drum 18 thus increasing the weight on the drill bit and decreasing the tension in cable 16. The brake is thus repeatedly pulsed into a deactivated condition until the tension in line 16 is decreased to the point that wiper 80 and contact 78 are no longer providing a current path through conductor 84 to ground. When such occurs, relay 82 stops actuation of its contacts in accordance with the periodic signal and drilling proceeds. When drilling again reaches the point when wiper 78 and contact 80 touch, the brake is again pulsed to let out additional cable.

If, for some reason, too much cable is let out thus placing excessive weight on the drill bit, wiper 80 and terminal 76 are placed in communication with one another thus energizing relay 86. When relay 86 is energized, compressed air from hose 111 is applied via hoses 124, 120 to the lower end of ram 122 thus forcing the ram into a brake-activating condition. Pressure is also applied to hose 126 in order to disengage the drawworks clutch to insure no additional drawworks movement. After an examination of the situation to determine the cause of placing excessive weight on the bit, the drawworks may be manually activated to reel in cable thus relieving the weight from the bit and drilling may proceed.

If, for some reason, it is desired that the operator be able to selectively deactivate the brake, switch 104 may be pushed to energize pneumatic relay 102 thus placing hoses 114, 116 in fluid communication and providing air pressure via hose 118 to the upper part of the ram. Such pressurization retracts rod 48 thus deactivating the brake for so long as switch 104 remains depressed.

It is to be appreciated that variations and modifications may be made to the disclosed preferred embodiment without departing from the spirit of the invention which is defined in the following claims.

What is claimed is:

1. Apparatus for controlling a brake on a drawworks having a cable wound thereon, said apparatus comprising:

means for sensing the tension level in said cable;

a first relay having a set of normally open contacts;

a pulse generator constructed to provide periodic pulses to one side of said first relay;

means for connecting the other side of said first relay to ground when said tension level is at or above a selected level;

means for disconnecting the other side of said first relay from ground when said tension level is below a selected level;

a pneumatic ram operatively connected to said brake for activating and deactivating said brake responsive to ram pressurization and depressurization;

a source of compressed air;

a first pneumatic relay operatively connected to said contacts, to said ram, and to said air source to that closing said contacts pressurizes said ram for brake deactivation and opening said contacts depressurizes said ram to permit brake activation;

a second relay having a set of normally open contacts;

a constant voltage source operatively connected to one side of said second relay for maintaining said second relay in an energized condition when the other side of said second relay is grounded;

means for connecting the other side of said second relay to ground when said tension level is at or below a selected tension level;

means for disconnecting the other side of said second relay from ground when said tension level is above a selected level; and a second pneumatic relay operatively connected to said second relay contacts, to said ram, and to said air source so that closing said second relay contacts pressurizes said ram to prevent brake deactivation and opening said second relay contacts depressurizes said ram to permit brake deactivation.

2. The apparatus of claim 1 wherein said apparatus further includes:

a switch;

a voltage source operatively connected to said switch;

a third pneumatic relay operatively connected to said switch, to said ram, and to said air source so that closing said switch pressurizes said ram for brake deactivation and opening said switch depressurizes said ram to permit brake activation.

3. In a control circuit for operation of a brake on a drawworks of the type having an air-powered clutch for engaging and disengaging the drawworks:

ram means having extended and contracted conditions, said ram means being operatively connected to said brake for activation and deactivation thereof;

means for biasing said ram means into a condition in which said brake is activated;

a source of compressed air;

a first pneumatic relay operatively connected to said air source and to said ram means for extension and contraction thereof responsive to energization and deenergization of said first pneumatic relay, said brake being activated responsive to energization of said first pneumatic relay; and a second pneumatic relay operatively connected to said air source and to said ram means for maintaining said brake in its biased condition responsive to energization of said second pneumatic relay.

4. The apparatus of claim 3 wherein said apparatus further includes a pneumatic connection between said second pneumatic relay and said drawworks clutch so that when said second pneumatic relay is energized, said clutch is disengaged.

5. The apparatus of claim 4 wherein said apparatus further includes a pulse generator operatively connected to said first pneumatic relay for causing pulsed energization thereof, said first pneumatic relay being deenergized when tension in said drawworks cable is below a selected level.

6. The apparatus of claim 5 wherein said apparatus further includes:

a third pneumatic relay operatively connected to said ram means and to said air source for extension and contraction of said ram means responsive to energization and deenergization of said third pneumatic relay; and a switch operatively connected to said third pneumatic relay for energization and deenergization thereof.

* * * * *